US006598245B2

(12) United States Patent
Nishioka

(10) Patent No.: US 6,598,245 B2
(45) Date of Patent: Jul. 29, 2003

(54) AUTOMATIC WATER FEED METHOD IN LAVATORY AND AUTOMATIC WATER FEED MECHANISM IN LAVATORY

(75) Inventor: Akira Nishioka, Osaka (JP)

(73) Assignee: San-Ei Faucet Mfg. Co., LTD, Osaka (JP)

( * ) Notice: Subject to any disclaimer, the term of this patent is extended or adjusted under 35 U.S.C. 154(b) by 0 days.

(21) Appl. No.: 10/041,226

(22) Filed: Jan. 8, 2002

(65) Prior Publication Data

US 2002/0104159 A1 Aug. 8, 2002

(30) Foreign Application Priority Data

Jan. 19, 2001 (JP) ..... 2001-011579

(51) Int. Cl.[7] ..... E03C 1/05

(52) U.S. Cl. ..... 4/623; 4/302; 4/303; 4/304; 222/52; 250/330; 340/565

(58) Field of Search ..... 4/623, 302, 303, 4/304; 250/330; 340/565; 222/52

(56) References Cited

U.S. PATENT DOCUMENTS 4,679,077 A * 7/1987 Yuasa et al. ..... 340/518
4,767,922 A * 8/1988 Stauffer ..... 250/221
5,025,516 A * 6/1991 Wilson ..... 4/623
5,133,095 A * 7/1992 Shiba et al. ..... 4/304
5,819,336 A * 10/1998 Gilliam et al. ..... 4/304
5,915,417 A * 6/1999 Diaz et al. ..... 137/624.11
5,980,123 A * 11/1999 Heifler ..... 340/567
5,984,262 A * 11/1999 Parsons et al. ..... 250/221
6,082,407 A * 7/2000 Paterson et al. ..... 137/801

* cited by examiner

*Primary Examiner*—Gregory L. Huson
*Assistant Examiner*—Azadeh Kokabi

(57) ABSTRACT

An automatic water feed mechanism and method is provided by equipping a lavatory with a two dimensional sensor array such as a camera unit for monitoring a target area that a user may enter. An infrared emitter and an infrared detector can also be activated at low light levels. A two dimensional image signal can be processed and compared with a stored reference signal for activating the release of water. At a low ambient light, the infrared emitter unit can be activated to emit infrared rays which can then be detected when reflected by a user by the infrared detector. Such a detection can provide an alternative release of water.

9 Claims, 10 Drawing Sheets

AUTOMATIC WATER FEED METHOD IN LAVATORY AND AUTOMATIC WATER FEED MECHANISM IN LAVATORY

BACKGROUND OF THE INVENTION

1. Field of the Invention

The present invention relates to a novel automatic water feed method in lavatory and a novel automatic water feed mechanism in lavatory, using an artificial retina sensor which visually recognize an user of a lavatory and a sensor unit which has light emitting means for emitting light to the user when the ambient lightness becomes lower than a specified level, and light receiving means for receiving the light reflected from the user.

2. Description of the Prior Art

FIG. 17 shows a conventional hand washer 602 for feeding water automatically by using a light reflection system. In FIG. 17, a sensor unit 603 comprises light emitting means (not shown) for emitting light $L_1$ such as infrared ray or near infrared ray toward the user U, and light receiving means (not shown) for receiving reflected light $L_2$ coming from the user U. When the reflected light $L_2$ is received, water is supplied from a discharge pipe 602*a* installed on a mounting plane 601 of a basin 600 of the hand washer 602.

However, since the light emitting means is set so that the light $L_1$ may be directed toward a bowl 604, if the bowl 604 is made of stainless steel or other metal of high reflectivity and the bottom is shallow, similar light other than the reflected light $L_2$ may enter the light receiving means, which may cause a wrong detection.

On the other hand, an automatic water feed mechanism comprising an image pickup unit for taking the image of hand of the user projected to the lower part of an automatic lavatory main body is proposed (see Japanese Unexamined Patent Publication No. 11-36396 gazette), but since the image pickup unit has a camera function, if a hand of the user is present in the water feed sensing range, it cannot be detected in a dark place or environment.

SUMMARY OF THE INVENTION

The invention is devised in the light of the above background, and it is hence an object thereof to be capable of sensing the user of the lavatory securely, and also sensing the user of the lavatory even in a dark place or environment.

To achieve the object, the invention presents an automatic water feed method in a lavatory characterized by controlling the water feed action of the lavatory such as flush urinal and hand washer by visually recognizing the user of the lavatory by means of an artificial retina sensor, and also controlling the water feed action of the lavatory by a sensor unit which has light emitting means for emitting light to the user when the ambient lightness becomes lower than a specified level, and light receiving means for receiving the light reflected from the user.

According to other aspect, the invention also presents an automatic water feed mechanism in a lavatory comprising a lavatory such as flush urinal or hand washer, an artificial retina sensor for visually recognizing the user of the lavatory, a sensor unit having light emitting means for emitting light to the user and light receiving means for receiving the light reflected from the user, and a controller for controlling the water feed action of the lavatory on the basis of the output from the artificial retina sensor or the output of the sensor unit.

That is, from the viewpoint that the artificial retina sensor or camera unit can visually recognize the user only in an illuminated light place, the invention is intended to activate the sensor unit such as infrared ray sensor of light reflection system not influenced by the lightness, instead of artificial retina sensor, in a dark place. That is, the invention, if the artificial retina sensor fails to function due to power failure or the like during use of lavatory, the infrared ray sensor functions instead.

Accordingly, the controller for controlling the water feed action of the lavatory of the invention has a darkness judging function to judge if the ambient lightness is light enough to recognize the user visually by the artificial retina sensor or not.

DETAILED DESCRIPTION OF THE PREFERRED EMBODIMENTS

Preferred embodiments of the invention are described below while referring to the accompanying drawings. It must be noted, however, that the invention is not limited by the illustrated embodiments alone.

FIG. 1 to FIG. 16 show one embodiment of the invention. In the embodiment, an infrared ray sensor is used in the sensor unit having light emitting means for emitting light to the user and light receiving means for receiving the light reflected from the user. Instead of the infrared ray sensor, a near infrared ray sensor may be also used.

Figure 1:
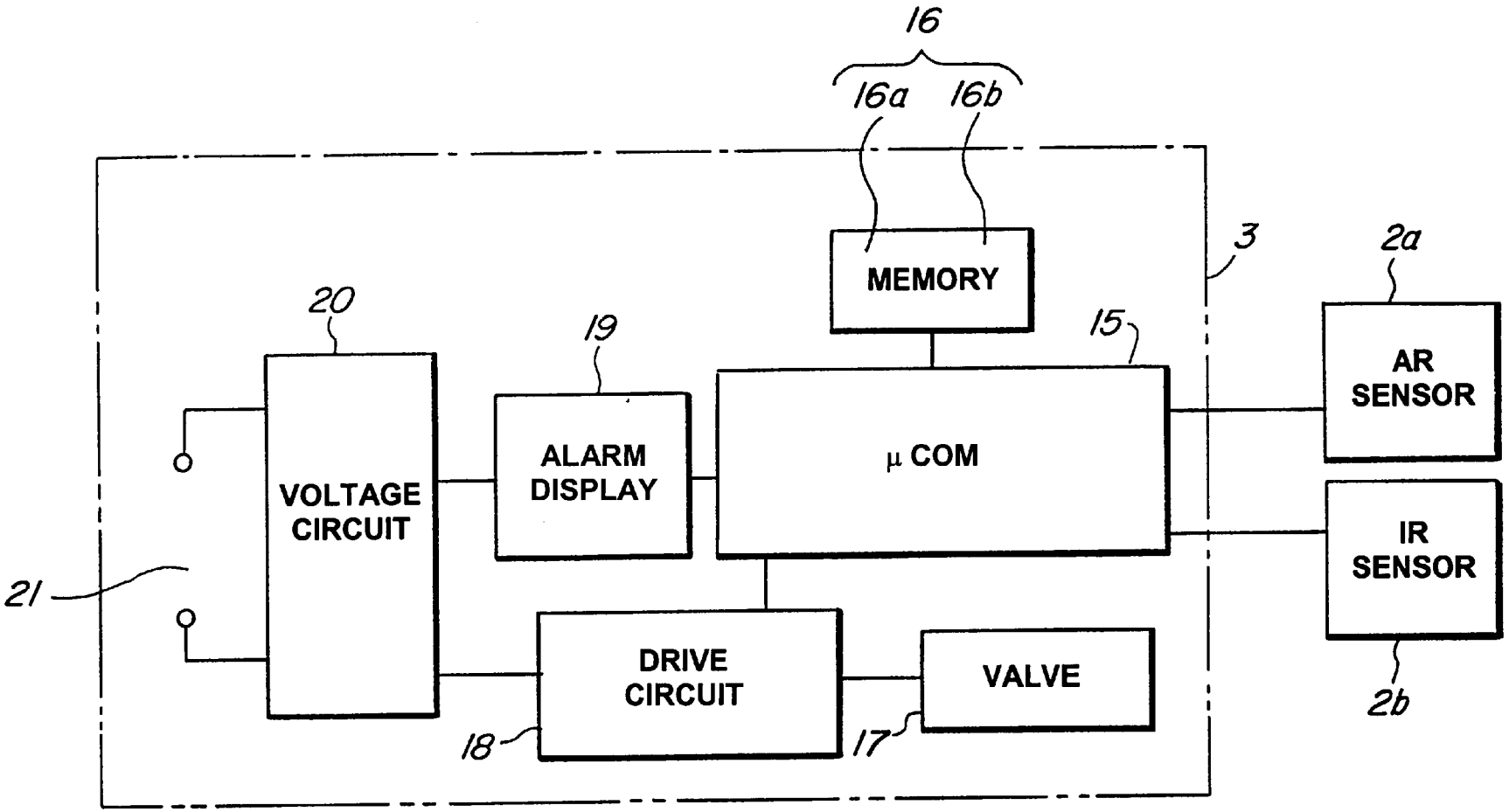
FIG. 1 is a general structural explanatory diagram showing one embodiment of the invention.
Figure 3:
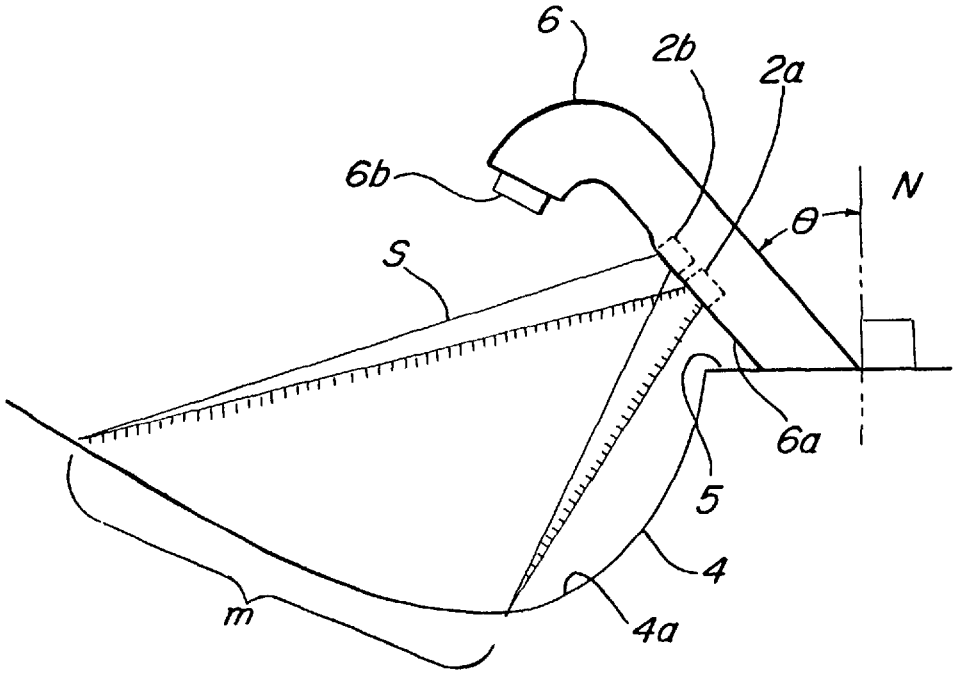
FIG. 3 is a structural explanatory diagram showing the viewing field region of artificial retina sensor in the embodiment.
Figure 4:
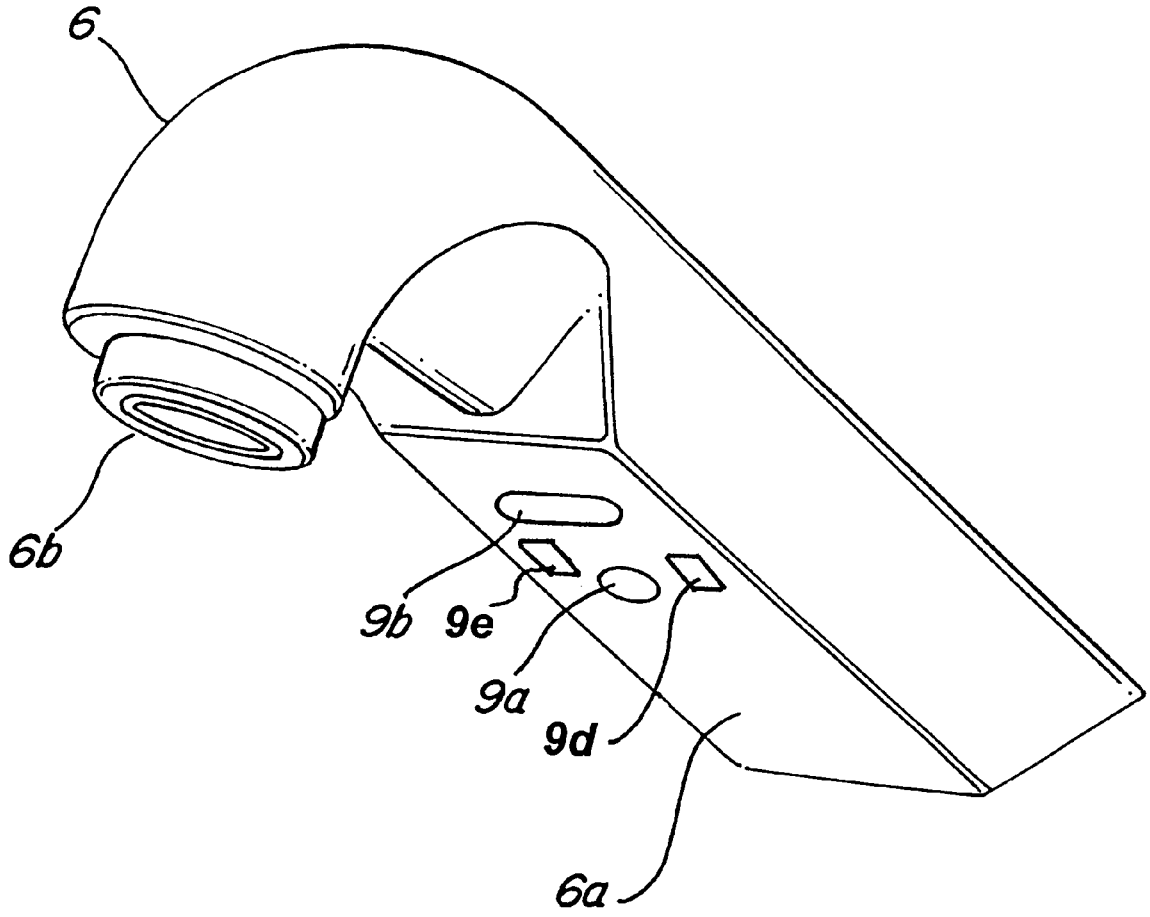
FIG. 4 is a diagram slantingly showing the water discharge pipe in the embodiment.

In FIG. 1, FIG. 3 and FIG. 4, an automatic water feed mechanism mainly consists of a hand washer 1, an artificial retina sensor 2*a*, an infrared ray sensor 2*b* and a control unit 3 for controlling the water feed operation of the hand washer 1 on the basis of the output of the artificial retina sensor 2*a* or the output of the infrared ray sensor 2*b*.

Further, the hand washer 1 is composed of a basin composed of bowl 4 and a horizontal mounting plane 5, and a faucet main body having a discharge pipe 6 installed on the horizontal mounting plane 5. The bowl 4 is white in color. The discharge pipe 6 is installed in such that the discharge port 6*b* is inclined by a specified angle ) ϕ (ϕ being an acute angle) from a vertical plane N perpendicular to the horizontal plane of the horizontal mounting plane 5 to the bowl 4 side so as to be directed to the bowl 4.

In the embodiment, the artificial retina sensor 2*a* and infrared ray sensor 2*b* are provided in a front panel 6*a* of a water discharge pipe 6 so that the infrared ray sensor 2*b* may be located above the artificial retina sensor 2*a*. In FIG. 4, reference numeral 9*a* is a sensing window of the artificial retina sensor 2*a*, which is circular in a front view. Reference numeral 9*b* is a light transmitting window of the infrared ray sensor 2*b*, which is elliptical, being long laterally in a front view. The front panel 6*a* is rectangular, being long vertically in a front view.

The artificial retina sensor 2*a* has a camera function, and is fitted to the front panel 6*a* so as to cover the viewing field region (m) of the surface 4*a* as shown in FIG. 3, of the surface 4*a* of the bowl 4. In this embodiment, the artificial retina sensor 2 has 1024 (32×32) pixels (dots).

Figure 2:
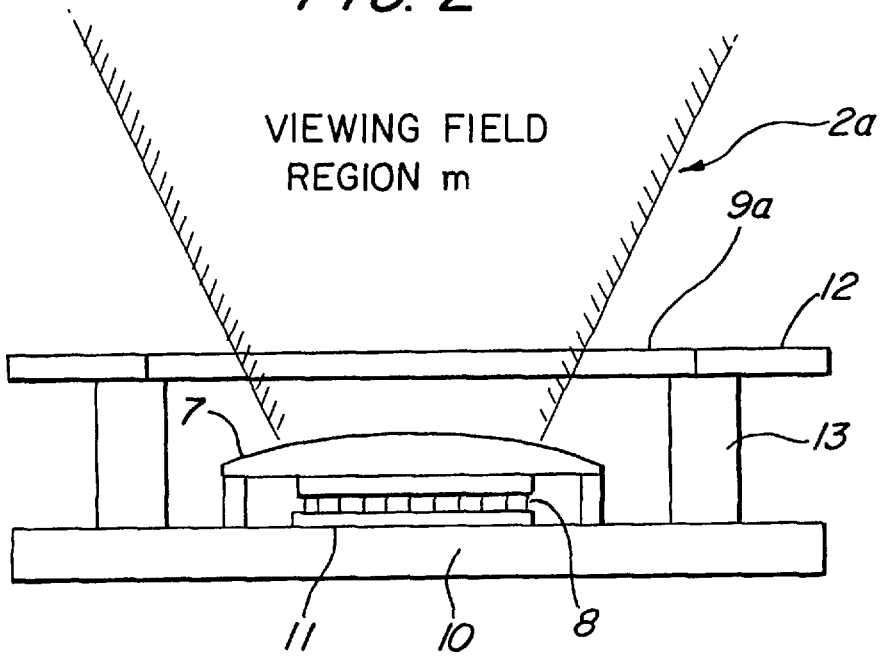
FIG. 2 is a structural explanatory diagram of the essential part in the embodiment.

The artificial retina sensor 2*a* is mainly composed of, as shown in FIG. 2, a wide-angle lens 7 of a circular front view forming the viewing field region (m), a photo detector element array 8 positioned in the rear panel side of the wide-angle lens 7, and a sensing window 9*a* of a circular front view positioned in the rear panel side of the wide-angle lens 7. The photo detector element array 8 is formed on a circuit board 11 of a square front view mounted on a base 10. In this embodiment, for example, 1024 photo detector elements corresponding to a 32×32 image plate are disposed on the circuit board 11. That is, in the embodiment, the 32×32 image plate is composed of the photo detector element array 8, circuit board 11, and base 10. Reference numeral 12 is a cover for surrounding the sensing window 9*a*, and 13 is a ring-shaped waterproof packing.

That is, in order to extend the viewing field region as much as possible, the wide-angle lens 7 is provided above the photo detector element array 8. By this wide-angle lens 7, the viewing field region (m) is set, as shown in FIG. 3.

For example, FIG. 7 to FIG. 10 show input images taken by the artificial retina sensor 2*a* in a light place. That is, FIG. 7 to FIG. 10 show images in the viewing field region (m) visible from the sensing window 9*a*.

Figure 9:
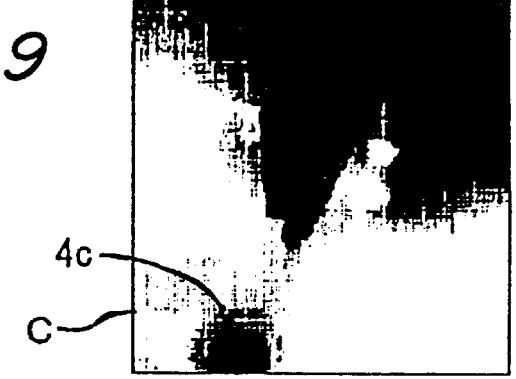
FIG. 9 is also a diagram showing an image seen from the sensing window when the user of the lavatory is washing hands in the embodiment.
Figure 10:
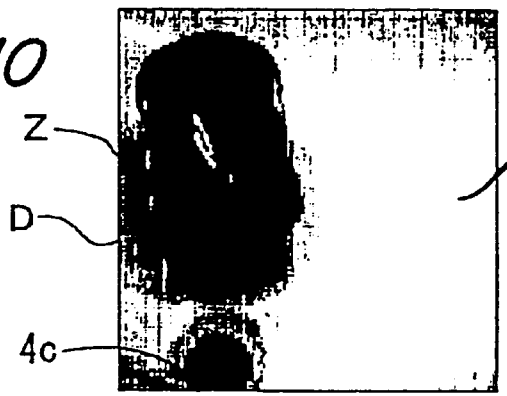
FIG. 10 is a diagram showing an image of the bowl surface depicting a foreign matter other than the hands of the user seen from the sensing window in the embodiment.
Figure 7:
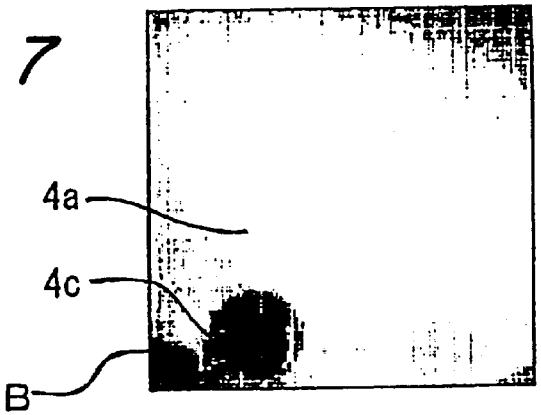
FIG. 7 is a diagram showing an image of surface of a bowl seen from a sensing window in the embodiment.
Figure 8:
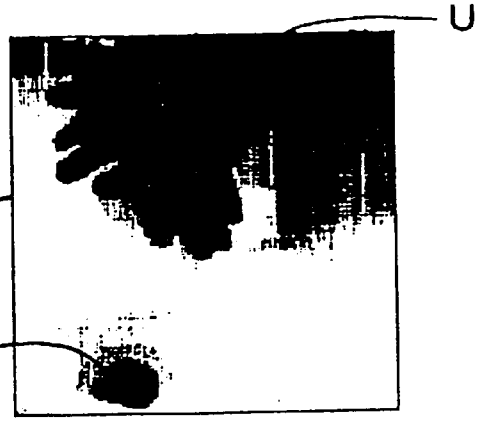
FIG. 8 is a diagram showing an image seen from the sensing window when the user of the lavatory is washing hands in the embodiment.

In FIG. 7, B is an input image of the surface 4*a* of the bowl 4 made of, for example, white porcelain seen from the sensing window 9*a*, and a drain hole 4*c* of the bowl 4 is depicted. In FIG. 8, A is an input image of the user U of the hand washer 1 as object of detection in the process of washing hands. In FIG. 9, C is an input image of the user U of the hand washer 1 as object of detection in the process of washing hands. In FIG. 10, D is an input image of the surface 4*a* of the bowl 4 showing foreign matter Z other than the hands of the user U. Meanwhile, the input images A, B, C, D, etc. are those obtained in the 32×32 image plates.

The control unit 3 controlls the water feed operation of the hand washer 1 on the basis of the output of the artificial retina sensor 2*a* or the output of the infrared ray sensor 2*b*, and is composed of, as shown in FIG. 1, a microcomputer 15, a memory 16 including two memory units 16*a*, 16*b*, a solenoid valve 17 responsible for water discharge and stopping action of the discharge pipe 6, a solenoid valve drive circuit 18 for driving and controlling the solenoid valve 17, a drive power source 21 of the control unit 3, an alarm display circuit 19 for displaying drop of supply voltage of the drive power source 21, and a low voltage circuit and voltage monitoring circuit 20.

Further, the microcomputer 15 has a function of judging the ambient darkness of the hand washer 1 (described below).

At first, the processing steps of input image captured by the artificial retina sensor 2*a* are shown. As the input image, an example of input image A in FIG. 8 is explained.

Figure 11:
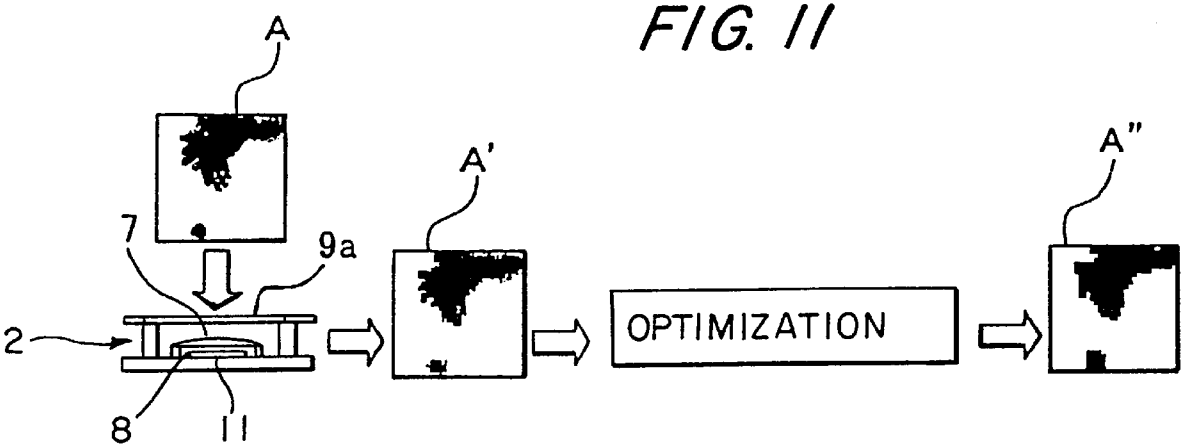
FIG. 11 is a structural explanatory diagram showing a processing step of an image seen from the sensing window in the embodiment.

In FIG. 11, (1) an input image A of the artificial retina sensor 2*a* is issued from the artificial retina sensor 2*a* as an output image A', and is input to the microcomputer 15.

(2) In the microcomputer 15, the output image A' is optimized, and a recognition object image is acquired. As optimizing process, for example, when binary processing (black and white processing) is done, a recognition object image A" as shown in FIG. 11 is obtained (see also FIG. 13).

Figure 13:
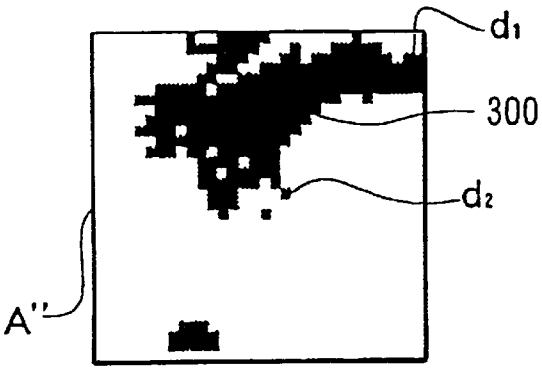
FIG. 13 is also a diagram showing an acquired image seen from the sensing window in the embodiment.

In the recognition object image A" shown in FIG. 13 and FIG. 11, the white area corresponds to the surface 4*a* of the bowl 4 of white porcelain, and the dark area 300 corresponds to an object existing on the porcelain surface 4*a*. That is, the dark area 300 in the recognition object image A" is an image corresponding to the hand of the user U. In the embodiment, the number of pixels (number of dots) of the artificial retina sensor 2*a* is 1024 (32×32), and the number of dots in the dark area 300 is, for example, 400.

(3) This recognition object image (hereinafter called acquired image) A" is stored into the memory 16 from the microcomputer 15.

Figure 12:
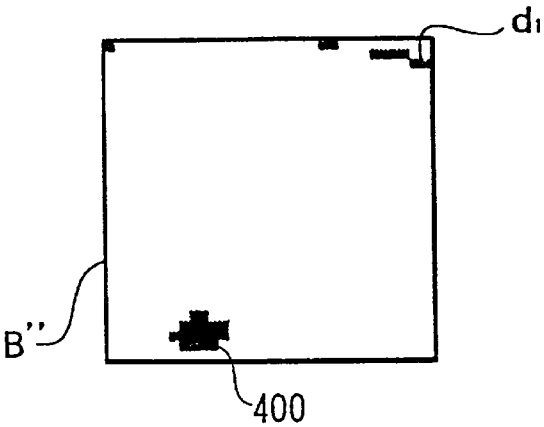
FIG. 12 is a diagram showing an acquired image seen from the sensing window in the embodiment.

Similarly, by the microcomputer 15, the input image B in FIG. 7 is processed as acquired image B" (see FIG. 12). In FIG. 12, the dark area 400 corresponds to the drain hole 4*c* of the bowl 4. The input image C in FIG. 9 is processed as acquired image C" (not shown). The input image D in FIG. 10 is processed as acquired image D" (not shown).

These acquired images A", B", C", D", and so forth are processed by the recognition algorithm in the memory 16.

Relating to the acquired image B", acquired image A", and acquired image C" which are continuously in time in this order, the processing procedure by the recognition algorithm is explained. By consecutive detection of acquired image B", acquired image A", and acquired image C", the hand of the user U can be recognized as the object of recognition.

As mentioned above, FIG. 12 and FIG. 11 (FIG. 13) show acquired images B" and A" of the input image B and input image A, respectively.

Figure 16:
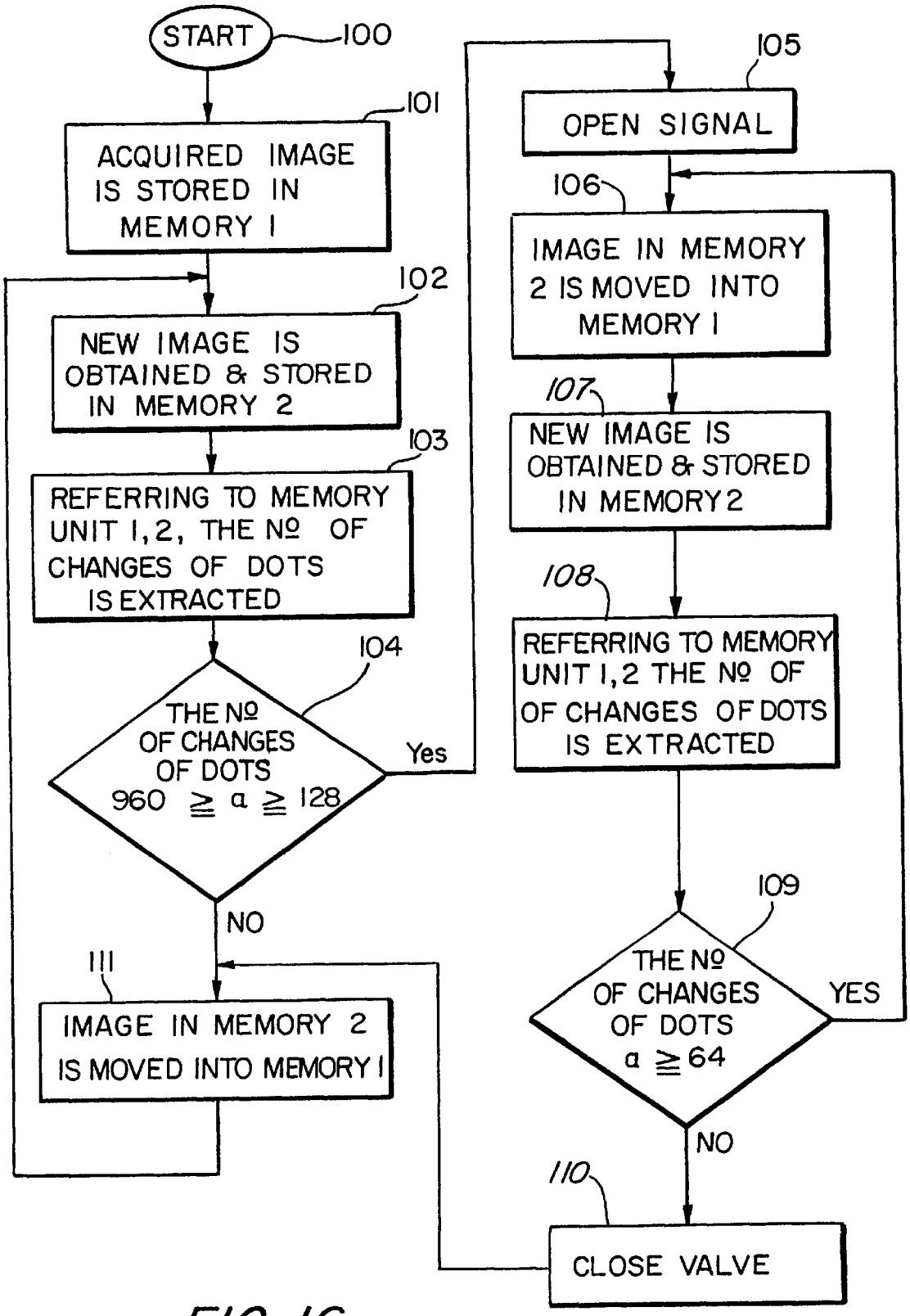
FIG. 16 is a flowchart showing an automatic water feed process used only an artificial retina sensor in the embodiment.
Figure 17:
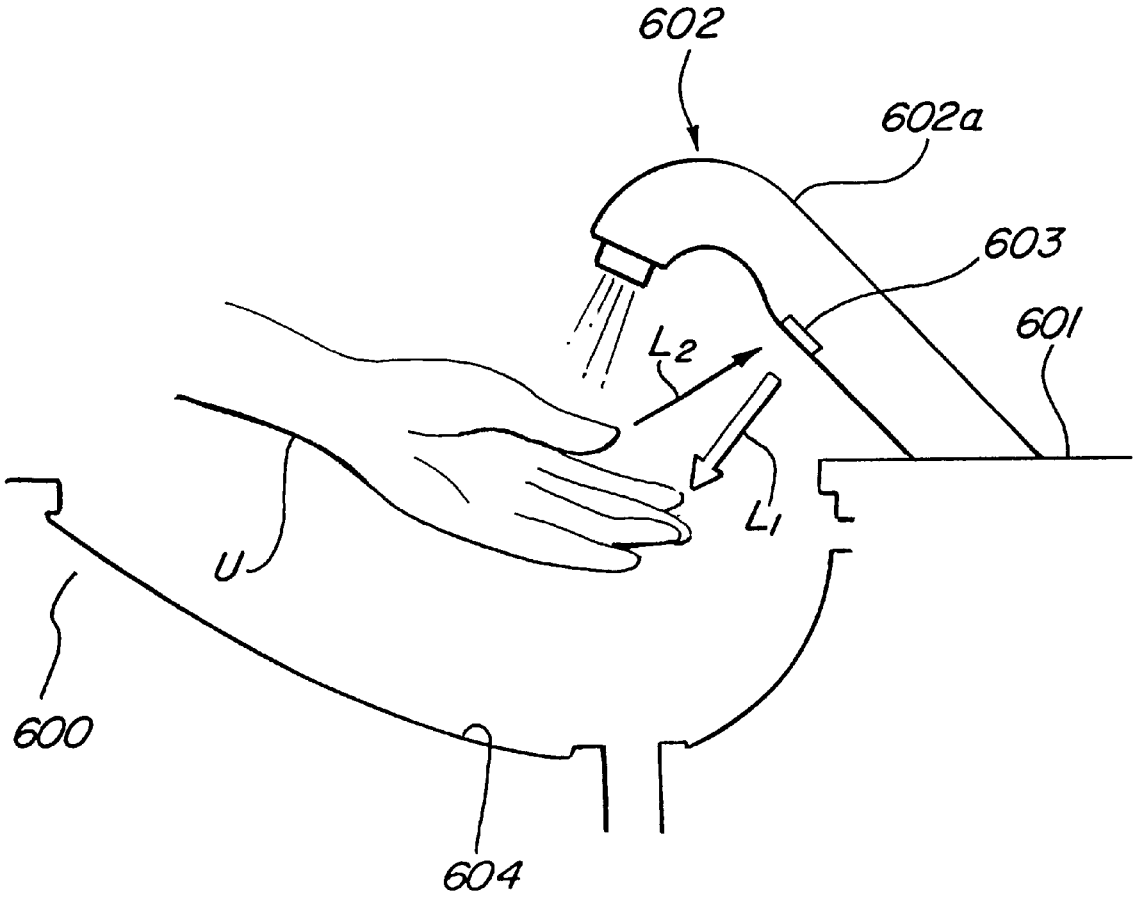
FIG. 17 PRIOR ART
FIG. 17 is a diagram showing a water feed operation in a prior art.

In FIG. 16, the user U goes to the hand washer 1 to wash hands (see step 100). First, at step 101, the acquired image B" while the user U is not washing hands is stored in the memory unit 16*a* (hereinafter called memory 1).

Next, when the user U extends hands to the bowl 4 for washing, the acquired image A" is taken, and the acquired image A" is stored in the memory unit 16*b* (hereinafter called memory 2) (see step 102).

Figure 14:
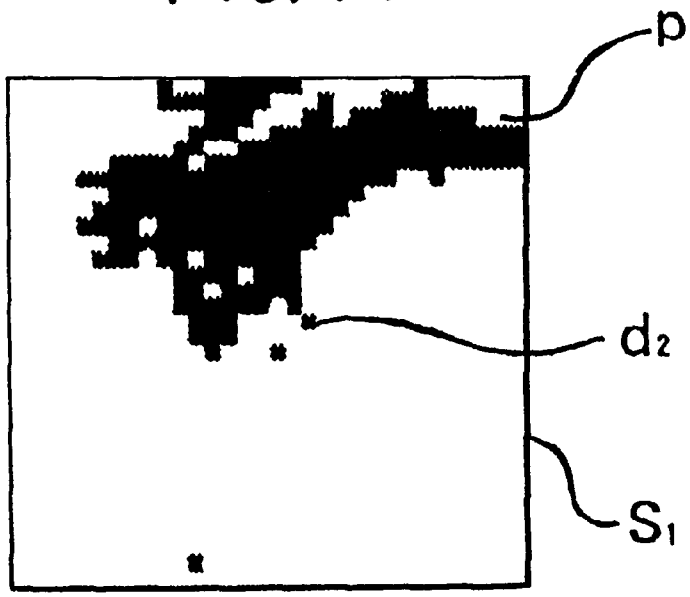
FIG. 14 is a diagram showing a change image extracting the number of dot changes in two continuous acquired images when transferring from non-use state to use state.

At step 103, referring to the memory 1 and the memory 2, the number of changes (a) of dots for composing the image is extracted. That is, in the memory 16, the acquired image B" stored first in time and the acquired image A" stored later in time are compared, and only the position changed in the number of dots (difference) is extracted, so that a change image $S_1$ showing a dot change as shown in FIG. 14 is obtained.

For example, in FIG. 12, dot $d_1$ in black display shown in the first acquired image B" is also shown in the later acquired image A" (see FIG. 13), and hence in the change image $S_1$, position p of location of dot $d_1$ (see FIG. 14) is displayed in white, which tells no change is made.

By contrast, dot $d_2$ in black display shown in the acquired image A" (see FIG. 13) is not found at the corresponding position in the acquired image B" (see FIG. 12), and therefore in the change image $S_1$, dot $d_2$ remains in black display.

This invention is designed to judge if the number of dot changes (a) recognized in the change image $S_1$ is within a specified range or not (see step 104). For example, the upper limit of number of dot changes (a) is 960, and the lower limit is 128.

That is, at step 104, when the number of dot changes (a) is judged to be within this range, a valve opening signal for opening the solenoid valve 17 is sent from the microcomputer 15 to the solenoid valve drive circuit 18, so that water is discharged from the discharge pipe 6 (see step 105).

(1) In this case, the acquired image B" stored earlier than the acquired image A" is deleted, and the acquired image A" is moved from the memory 2 (16*b*) into the vacated memory 1 (16*a*) (see step 106).

In succession, the acquired image C" acquired later in time than the acquired image A" is stored into the vacated memory 2 (16*b*) (see step 107).

Further, same as at step 103, referring to the memory 1, 2, the number of dot changes (a) for composing the image is extracted (see step 108). That is, in the memory 16, the acquired image A" stored first in time and the acquired image C" stored later in time are compared, and only the position changed in the number of dots is extracted, so that a change image $S_2$ showing a dot change as shown in FIG. 15 is obtained.

Figure 15:
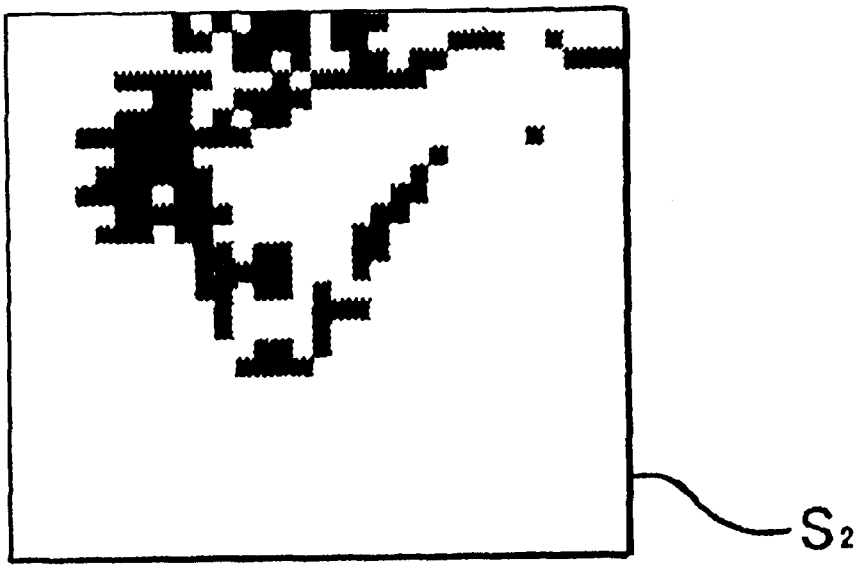
FIG. 15 is a diagram showing a change image extracting the number of dot changes in two continuous acquired images during use.

That is, in FIG. 15, comparing two acquired images A" and C" as the object of detection during use of the hand washer, the change image $S_2$ extracting only dot changes in the acquired images A", C" is shown.

In this case, when the number of dot changes (a) in the extracted change image $S_2$ is 64 or more, it is judged that the hand washer is being used (see step 109), and the acquired images C" and subsequent images are acquired continuously. Then the process returns to step 106. On the other hand, if the number of changes (a) becomes smaller than 64, it is judged that the hand of the user U is away from the hand washer 1, and a close signal for closing the solenoid valve 17 is sent from the microcomputer 15 to the solenoid valve driving circuit 18 (see step 110).

(2) At step 104, if the number of dot changes (a) is judged to be out of the specified range, the acquired image B" stored earlier than the acquired image A" is deleted, and the acquired image A" is moved from the memory 2 (16*b*) into the vacated memory 1 (16*a*) (see step 111). Then the process returns to step 102.

Thus, changes in the number of dots are operated in two consecutive acquired images B", A", and A", C", and the motion of the object of sensing is detected by the difference, so that the water feed operation can be controlled easily.

On the other hand, the infrared ray sensor 2*b* has a lighting element (light emitting means) 9*e* for illuminating the user by infrared ray (light) and a photo detector (light receiving means) 9*d* for receiving the infrared ray (light) reflected from the user (see, for example, the specification and drawings of Japanese Patent Application No. 2000-34653 3).

The lighting element 9*e* and photo detector 9*d* are located between the circuit board and light transmitting window 9*b* in a mounted state in the light emitting region and light receiving region respectively formed on the surface of the circuit board; see FIG. 4.

Figure 5:
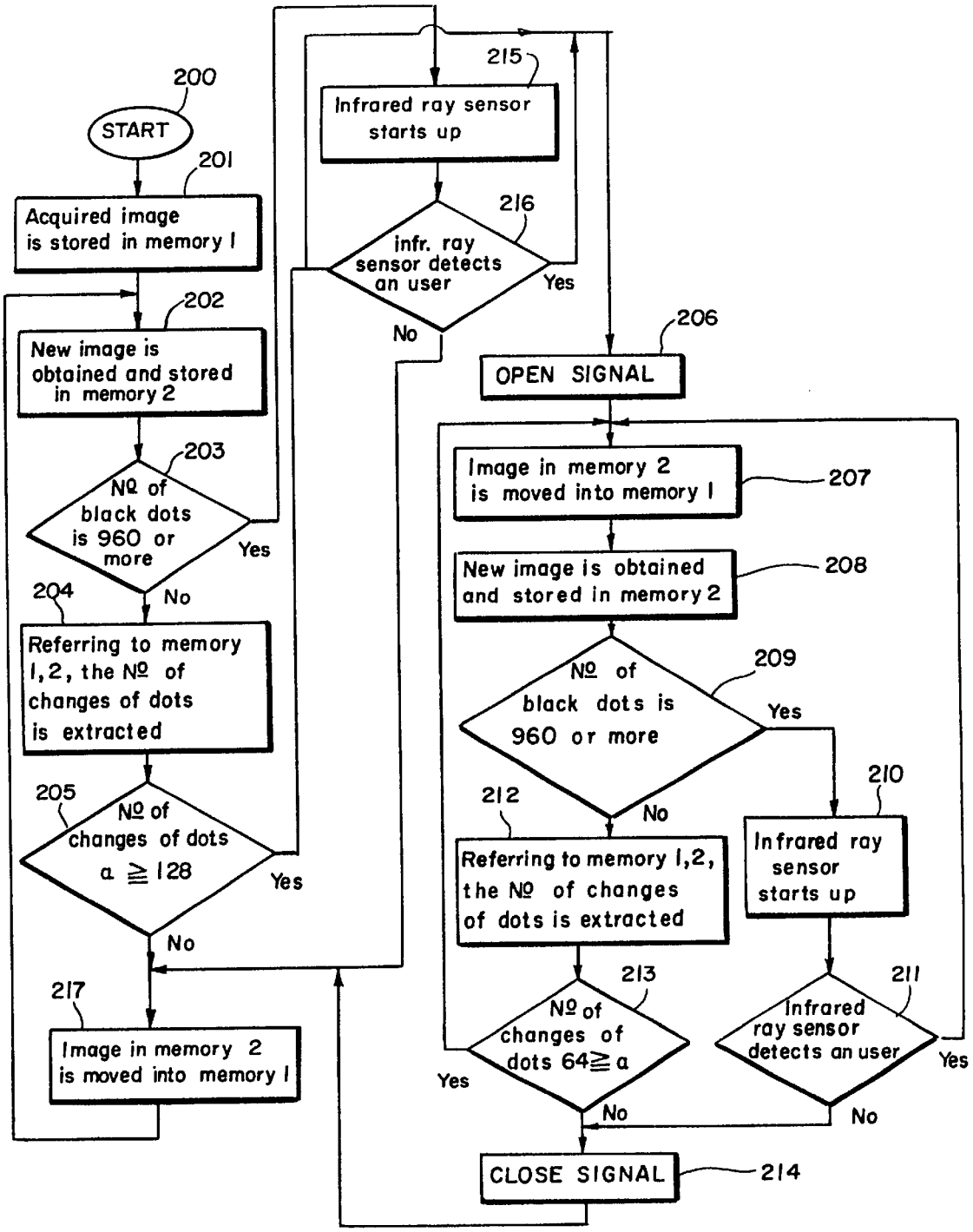
FIG. 5 is a flowchart showing automatic water feed process in the embodiment.

According to the water feed procedure shown in FIG. 7, FIG. 8, and FIG. 9, the automatic water feed process in the hand washer 1 is explained by referring to FIG. 5.

In FIG. 5, (1) suppose the user U goes to an illuminated hand washer 1 to wash hands (see step 200). At step 201, an acquired image B" when the user U is not washing hands is stored in the memory unit 16*a* (hereinafter called memory 1).

Next, when the user U projects hands to the bowl 4 to wash hands, an acquired image A" is obtained, and the acquired image A" is stored in the memory unit 16*b* (hereinafter called memory 2) (see step 202).

At step 203, it is judged if the artificial retina sensor 2*a* can recognize the user visually or not on the basis of the number of dots (d) composing the dark area 300 of the acquired image A" stored in the memory 2. That is, the place of installation of the artificial retina sensor 2*a* is judged to be light enough to recognize the user visually or not by the artificial retina sensor 2*a* (this is called darkness judgement).

Herein, the lightness allowing the artificial retina sensor 2*a* to function is set at the number of pixels (number of dots) of the artificial retina sensor 2*a* of 1024 (32×32) in this embodiment, and the number of dots (d) is set at 960 or less, and the darkness not allowing the artificial retina sensor 2*a* to function is set at the number of dots (d) of more than 960.

This value of 960 is the maximum number of dots in the dark area appearing in the image acquired when the hand is brought closer to the artificial retina sensor 2*a* than in the case of the image A shown in FIG. 8 of the user U during hand wash. If the number of dots (d) as the reference for darkness judgement is set at smaller than 960, for example, 800, when exceeding 800, for example, if the dark area of the image acquired when the hand is brought closer to the artificial retina sensor 2*a* is composed of 850 dots, it causes an inconvenience of failure of function of the artificial retina sensor 2*a* in spite of enough lightness.

When illuminated, the number of dots (d) for composing the dark area 300 of the acquired image A" is, for example, 400 and is less than 960. At step 204, referring to the memory 1 and memory 2, the number of changes of dots (a) for composing the image is extracted. That is, in the memory 16, the acquired image B" stored earlier in time and the acquired image A" stored later in time are compared, and only the positions having dot changes (difference) are extracted, and a change image $S_1$ showing dot changes is obtained as shown in FIG. 14.

The number of changes of dots (a) recognized in the change image $S_1$ is judged to be within a specified range or not (see step 205). Since the number of changes of dots (a) is more than 128, an open signal for opening the solenoid valve 17 is issued from the computer 15 to the solenoid valve driving circuit 18, and water is discharged from the discharge pipe 6 (see step 206).

(1) In this case, the acquired image B" stored earlier than the acquired image A" is deleted, and the acquired image A" is moved from the memory 2 (16*b*) into the vacated memory 1 (16*a*) (see step 207).

Successively, the acquired image C" obtained later than the acquired image A" is stored in the vacated memory 2 (16*b*) (see step 208).

At next step 209, too, darkness is judged. That is, during water feed, if the illumination of the hand washer 1 is turned off by power failure or the like, the number of dots (d) for composing the dark area of the acquired image L" at this time is more than 960, and the function of the artificial retina sensor 2*a* stops, and the infrared ray sensor 2*b* starts up (see step 210).

Figure 6:
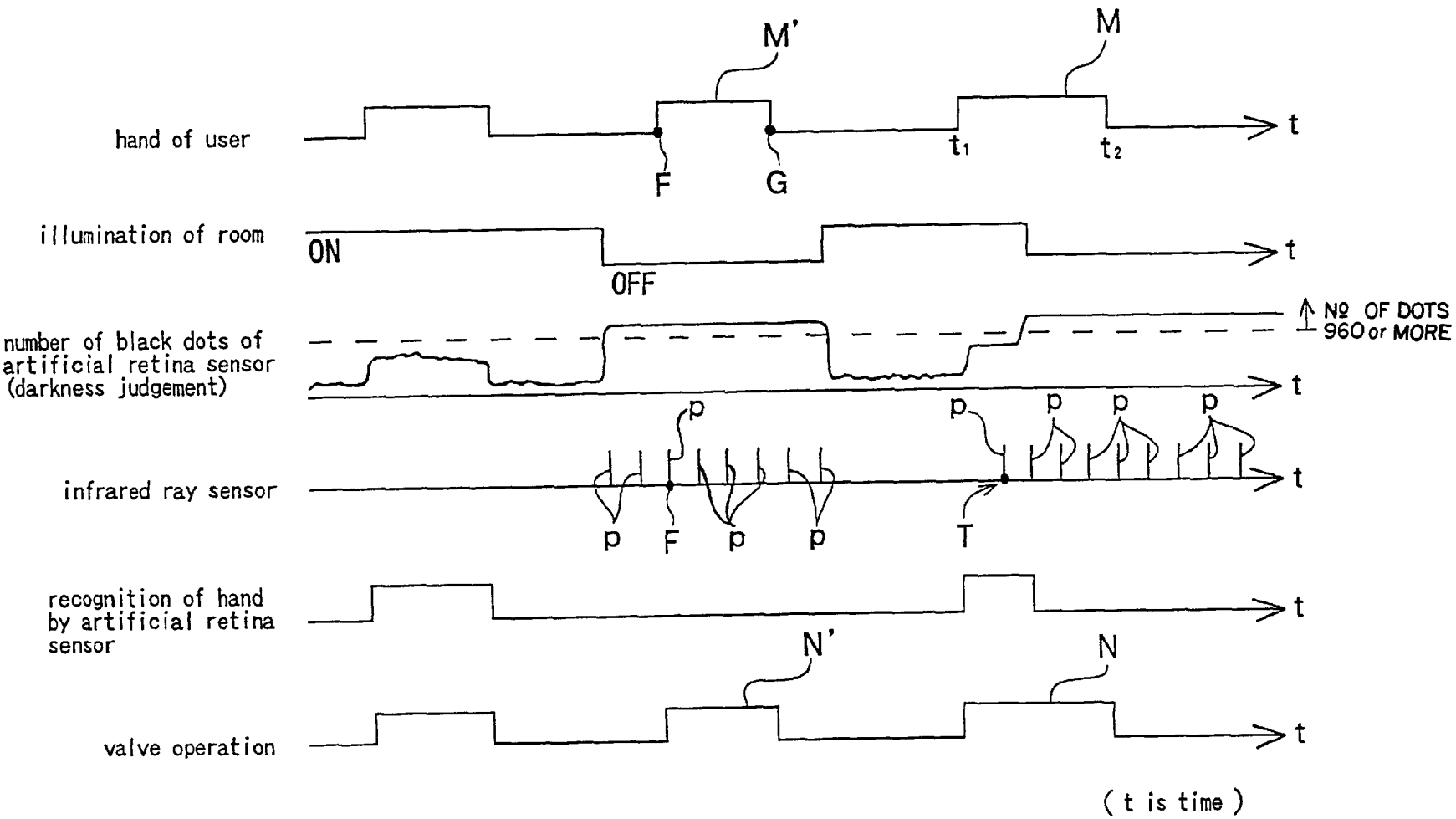
FIG. 6 is a timechart showing automatic water feed process in the embodiment.

For example, in the time chart shown in FIG. 6, the infrared ray sensor 2*b* starts at time T, and during the dark period after the number of pulses set by the timer, the infrared ray S (see FIG. 3) is emitted intermittently. In this case, at step 211 following step 210, the infrared ray reflected from the hand of the user U is received by the infrared ray sensor 2*b*, and the water feed action continues (see N in FIG. 6) as far as the user U is projecting hands (see M in FIG. 6) even in a dark place. That is, M shows the state of the user U extending hands to the discharge pipe 6, $t_1$ is its start time, and $t_2$ is its end time. Moreover, N shows the water feed state.

On the other hand, at step 209, in the absence of power failure or the like, while the illumination of the hand washer 1 is lit, by referring to the memory 1 and memory 2, the number of changes of dots (a) for composing the image is extracted (see step 212). That is, in the memory 16, the acquired image A" stored earlier in time and the acquired image C" stored later in time are compared, and only the positions having dot changes are extracted, and a change image $S_2$ showing dot changes is obtained as shown in FIG. 15.

In this case, when the number of changes of dots (a) in the extracted change image $S_2$ is more than 64, it is judged to be in the process of use (see step 213), and images after the acquired image C" are acquired consecutively. When the number of changes of dots (a) becomes smaller than 64, it is judged that the hands of the user U are away from the hand washer 1, and a close signal for closing the solenoid valve 17 is issued from the computer 15 to the solenoid valve driving circuit 18 (see step 214). Then the process goes to step 217 (described later).

Next, (2) suppose the user U uses the hand washer 1 in a darkness without lighting illumination (see step 200). At step 201, an acquired image X" when the user U is not washing hands is stored in the memory 1 (16*a*).

Next, when the user U projects hands to a dark bowl 4 to wash hands, an acquired image Y" is obtained, and the acquired image Y" is stored in the memory 2 (16*b*) (see step 202).

At step 203, darkness is judged, and since the illumination is not lit, the number of dots (d) composing the dark area of the acquired image Y" is more than 960. Since the illumination is not lit, the infrared ray S has been emitted intermittently before this moment (time F). That is, from the infrared ray light sensor 2*b* already active at step 215, the hands of the user U are illuminated, and the infrared ray reflected from the hands of the user U is received by the infrared ray sensor 2*b*, and the water feed action continues (see N' in FIG. 6) as far as the user U is projecting hands (see M' in FIG. 6). That is, M' shows the state of the user U extending hands to the discharge pipe 6, F is its start time, and G is its end time. Moreover, N' shows the water feed state.

When illuminated at step 202, referring to the memory 1 and memory 2 at step 204, and the number of changes of dots (a) for composing the image is extracted. That is, in the memory 16, the acquired image B" stored earlier in time and the acquired image A" stored later in time are compared, and only the positions having dot changes (difference) are extracted, and a change image $S_1$ showing dot changes is obtained as shown in FIG. 14.

The number of changes of dots (a) recognized in the change image $S_1$ is judged to be within a specified range or not (see step 205). Since the number of changes of dots (a) is more than 128, an open signal for opening the solenoid valve 17 is issued from the computer 15 to the solenoid valve driving circuit 18, and water is discharged from the discharge pipe 6 (see step 206).

In this case, the acquired image B" stored earlier than the acquired image A" is deleted, and the acquired image A" is moved from the memory 2 (16*b*) into the vacated memory 1 (16*a*) (see step 217).

Successively, the acquired image C" obtained later than the acquired image A" in time is stored in the vacated memory 2 (16*b*) (see step 202).

In the present invention, the number of photo detector elements is, natually, not limited to 1024.

Also, the present invention is not limited to the hand washer, but may be applied in the flush urinal and other lavatories.

What is claimed is:

1. An automatic water feed method in a lavatory characterized by controlling the water feed action of a hand washer by visually recognizing a two dimensional image of a user of the lavatory by means of an artificial retina sensor having an array of pixel elements, and separately controlling the water feed action of the lavatory by a sensor unit which has light emitting means for emitting light to the user when the ambient light becomes lower than a specified level and light receiving means for receiving the light reflected from the user.

2. The automatic water feed method of claim 1 further comprising aligning the artificial retina sensor to be aligned with a view into a bowl of the hand washer.

3. An automatic water feed mechanism in a lavatory characterized by comprising a hand washer, an artificial retina sensor having an array of pixel elements for visually recognizing a two dimensional image of a user of the lavatory, a sensor unit having light emitting means for emitting light to the user and light receiving means for receiving the light reflected from the user, and a controller for controlling the water feed action of the lavatory on the basis of the output from one of the artificial retina sensor and the output of the sensor unit.

4. The automatic water feed mechanism of claim 3 wherein the hand washer includes a bowl and the artificial retina sensor has an optical axis extending into the bowl.

5. An automatic water feed mechanism comprising:

a water feed unit for releasing water;

an artificial retina sensor unit for monitoring a target area and providing a two dimensional image signal of any objects within the target area;

a memory unit for storing a reference image signal; and a controller unit for receiving a two dimensional image signal from the artificial retina sensor unit and comparing it with the reference image signal, the controller unit activating the water feed unit to release water when a comparison indicates an acceptable match of the two dimensional image signal with the stored reference image signal.

6. The automatic water feed mechanism of claim 5 further comprising an infrared emitter unit and an infrared detector unit, the infrared emitter unit is activated by the controller unit at a predetermined ambient light level and the infrared detector unit is activated to provide a signal so that the controller unit can determine when a predetermined amount of infrared is received to activate the water feed unit, whereby the water feed unit can be alternatively activated by either the artificial retina sensor unit or the infrared detector unit.

7. The automatic water feed mechanism of claim 5 wherein the controller unit counts the number of pixel elements within the two dimensional image signal to enable a comparison.

8. A method of automatically releasing water from a water feed unit monitored by a camera unit for providing a two dimensional image signal and monitored by an infared detector unit that can receive reflected radiation from an infrared emitter unit comprising the steps of:

storing a predetermined two dimensional reference image signal representative of a user entering a predetermined target area adjacent the water feed unit;

receiving a two dimensional image signal from the camera unit;

comparing the stored two dimensional reference image signal with the two dimensional image signal from the camera unit and when an acceptable match is made, activating the water feed unit to release water;

determining, when an acceptable match is not made, that the ambient light is too low to permit the camera unit to provide an acceptable two dimensional image and activating the infared emitter unit; and determining if sufficient reflected radiation is received by the infared detector unit to activate the water feed unit to release water.

9. The method of automatically releasing water of claim 8 further including, in the comparing step, initially counting pixel elements in the two dimensional image signal from the camera unit.

* * * * *